United States Patent [19]

Borque

[11] 4,258,494

[45] Mar. 31, 1981

[54] CROSS ARM YARD SIGN SUPPORT

[76] Inventor: George O. Borque, 665 Jackson Ave., Winter Park, Fla. 32789

[21] Appl. No.: 50,667

[22] Filed: Jun. 21, 1979

[51] Int. Cl.[3] ..... G09F 15/00

[52] U.S. Cl. ..... 40/607

[58] Field of Search ..... 40/11, 607, 606, 617, 40/612

[56] References Cited

U.S. PATENT DOCUMENTS

| | | | |
|---|---|---|---|
| 1,603,311 | 10/1926 | Brett et al. | 40/607 |
| 2,926,442 | 3/1960 | Reimel | 40/617 |
| 4,091,553 | 5/1978 | Glennie | 40/617 |

FOREIGN PATENT DOCUMENTS

| | | | |
|---|---|---|---|
| 1294217 | 4/1962 | France | 40/11 |
| 1325735 | 3/1963 | France | 40/11 |

*Primary Examiner*—Gene Mancene
*Assistant Examiner*—Wenceslao J. Contreras
*Attorney, Agent, or Firm*—Macdonald J. Wiggins

[57] ABSTRACT

A crossarm type support having a vertical post formed from a rectangular tube having a set of internal splines. Spike elements formed from flat steel stock are bolted in the lower end of the posts. A plastic stabilizer block is inserted between the spikes for strengthening the base of the post. The post is installed in the ground by pushing on a horizontal portion of a spike with a heel or by the use of a hammer or the like. A crossarm is provided at the upper end formed from a second rectangular tube having a grooved channel along its lower edge and a slotted channel along its upper edge. The vertical posts and crossarm are mortised to form complementary notches for mounting the crossarm to the post. The post and internal splines interlock with the crossarm and channels to provide internal support and rigidity to the joint. The lower crossarm channel receives hooks for attaching a hanging sign and the upper channel includes a plastic insert for receiving an interchangeable rider sign.

6 Claims, 7 Drawing Figures

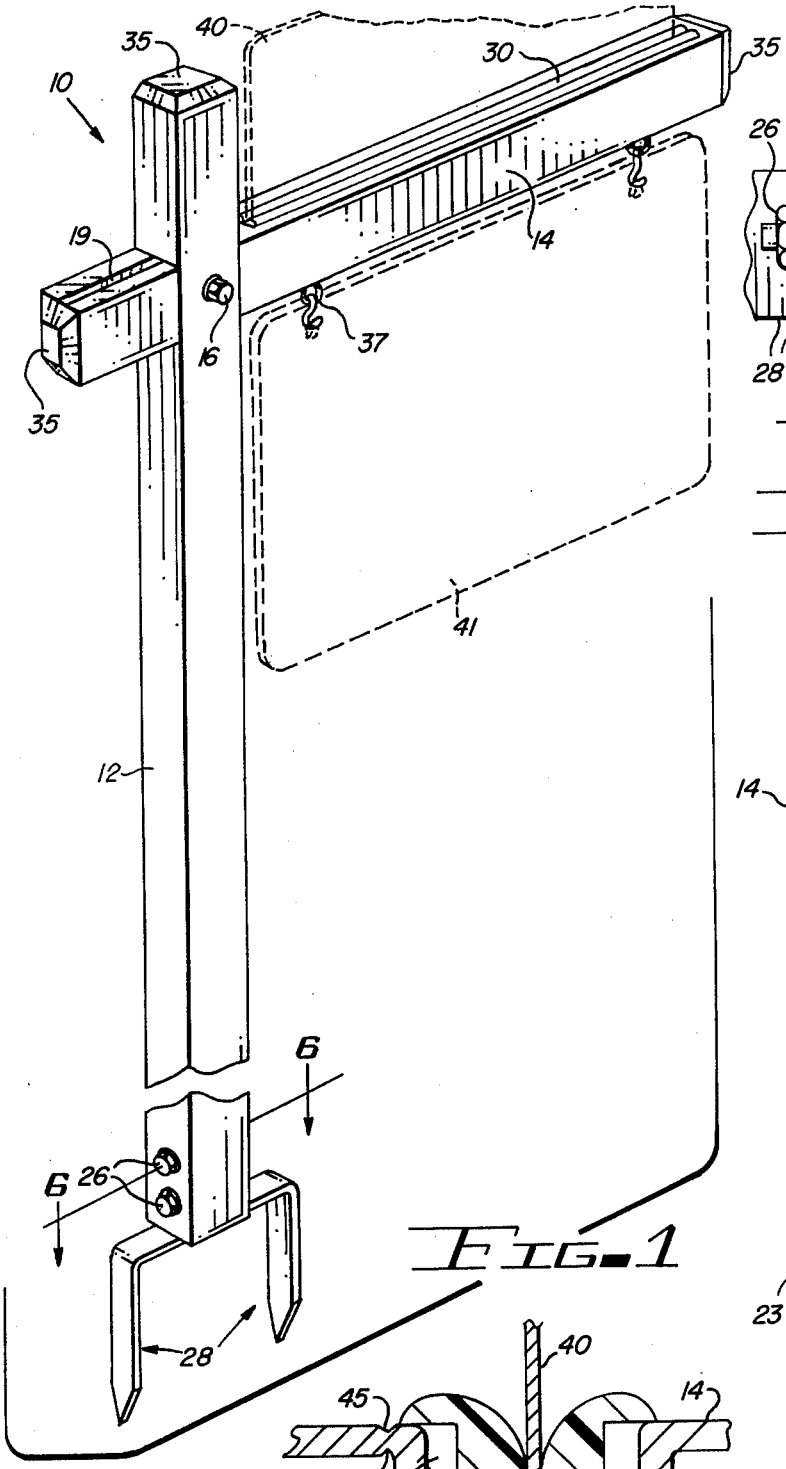
FIG. 1
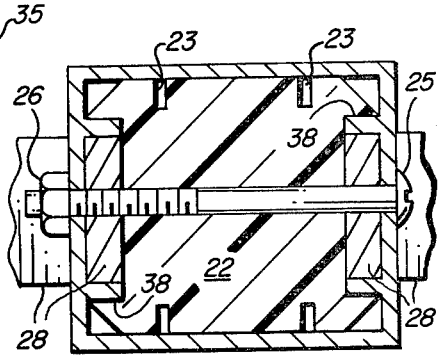
FIG. 6
FIG. 3
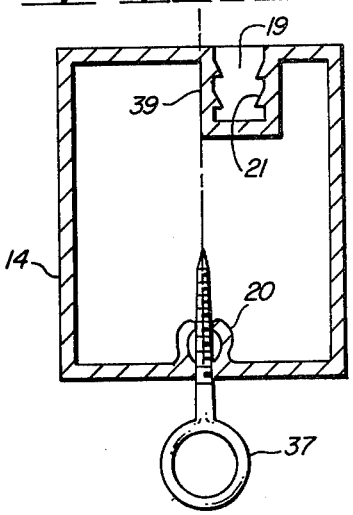
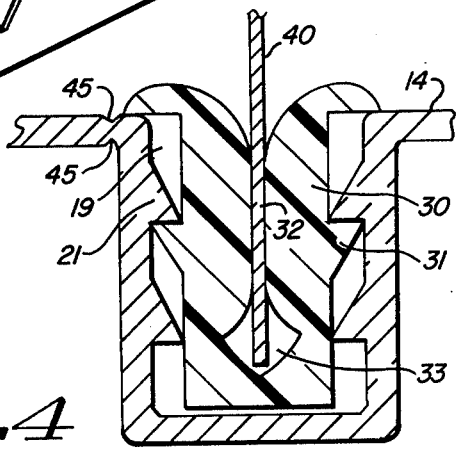
FIG. 4
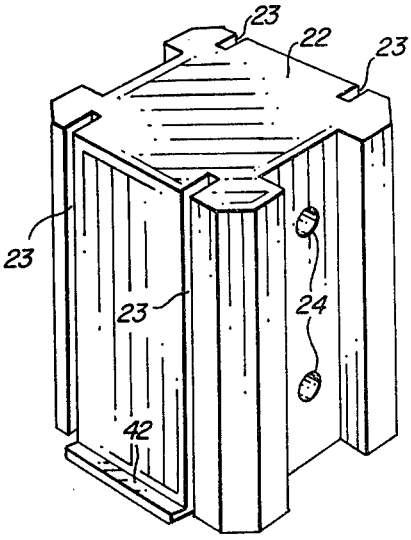
FIG. 7

CROSS ARM YARD SIGN SUPPORT

BACKGROUND OF THE INVENTION

1. Field of the Invention

The present invention relates to a post support for signs and the like and more particularly to a portable cross arm yard sign post.

2. Description of the Prior Art

Cross arm type sign support posts are widely used, particularly in connection with the sale of real estate where a sign is to be provided on the lawn or lots being advertised. When the signs are no longer needed, it is required that the support post be removed and reused.

It is common to install a post in a hole dug in the ground which is inconvenient and, in some cases, damaging to the property. Other approaches, as exemplified by U.S. Pat. No. 4,120,125 to Cvetan, have proposed a socket with a single downward projecting spike to be driven in the ground and the post inserted into the socket. The socket unit requires a special tool for driving the spike into the ground, the tool being removed and the post being inserted thereafter. A tool similar to an automobile jack is then required to remove the socket and spike from the ground.

In real estate work, it is usually desirable to provide a large sign offering the property for sale and carrying the name and logo of the real estate broker. Such signs may be standard and manufactured in large quantities to reduce the cost over a custom sign. When such standardized signs are used, it is often necessary to provide a rider type auxiliary sign to note special features concerning the property; for example, the number of bedrooms, a swimming pool, or other special features. Rider signs are also used to indicate when the property has been sold thereby providing favorable notice for the listing real estate broker.

There has been a need for real estate type sign supports, particularly for a lightweight, relatively low cost cross arm type sign support which can be quickly and easily installed on a lawn with minimum damage thereto and easily removable therefrom. Such a sign support must also be easily assembled to minimize cost, must be attractive to complement high quality residences and the like, and must have a long service life. A real estate sign support post is also needed that will allow rider type signs to be quickly and easily installed by a real estate salesman without tools and in which the rider sign can be quickly changed when required.

SUMMARY OF THE INVENTION

The present invention is a cross arm type support post for signs which is particularly adapted for real estate use and which meets all of the above mentioned requirements. The support post utilizes two novel extrusions which provide both functional and structural features. An upright post section is provided which in one embodiment may be of an extruded rectangular tube-form having specially designed internal ribs. The cross arm portion may also be an extruded, rectangular, tube-like member having an upper channel for accepting an insert, and a lower channel into which sign retaining screws may be threaded. The cross-sectional designs of the upright post and the cross arm are made complementary to provide a rigid interlocking joint with no external bracing required. The lower end of the vertical post extrusion is adapted to receive a novel stabilizing block and a pair of flat steel spike elements. The stabilizer block and the upper ends of the spike elements fit the lower end of the upright post extrusion to form a snug, solid end for rigidity and strength. The spike and stabilizer assembly may be securely attached to the tube with two bolts. The lower ends of the spikes are formed as downward extensions of outwardly extending horizontal sections. The installer may force the spikes into the ground by pushing downward on the horizontal sections with his foot or heel. In harder ground, the spikes may be driven in with readily available tools.

For lightweight and minimum cost, it is preferable that the vertical post extrusion and the horizontal cross arm extrusion be formed from aluminum and anodized. Caps of polypropylene or similar plastic material may be used to finish off the top end of the vertical post and each end of the horizontal cross arm for appearance and to prevent water intrusion. The channel in the top surface of the cross arm is formed to accept a novel insert which may be of polypropylene or similar pliable plastic material. The insert, which may extend the length of the supporting side of the cross arm, has a longitudinal cut along its length to form a slot therein into which a thin rider sign may be inserted. Due to the ability of the plastic insert to compress slightly, such an inserted sign is tightly gripped by friction between the insert and the sign but may be readily removed for change or dismantling. It is contemplated that the cross arm will support a main large sign hanging therefrom. For this purpose, screw eyes, screw hooks or the like are required to be threaded into the lower surface of the cross arm. Advantageously, the screw receiving slot or channel is extruded along the lower surface of the cross arm material. This slot has C-shaped sides such that a self-tapping type thread or a wood screw thread may be driven into the lower surface at any point along the slot, cutting threads at the lower edge of the slot and also along the top edge thereby securely holding the fasteners.

As may now be recognized the cross arm type support post may be quickly installed on a lawn or in other ground without digging being required, a large sign hung from hooks threaded at any desired location along the underside of the cross arm, and special rider signs quickly inserted and removed from a groove in the top surface of the cross arm. Similarly, the support post may be quickly disassembled and removed when no longer required by unhooking the major sign, pulling the rider sign out of its slot, and by rocking the vertical post loosening the spikes, allowing easy removal from the ground.

It is therefore a principle object of the invention to provide a low cost, attractive, and lightweight cross arm type support post for yard signs and the like.

It is another object of the invention to provide a yard sign post that is quickly and easily installable and removable.

It is yet another object of the invention to provide a cross arm type yard sign post in which a rider sign can be inserted in the cross arm and in which the rider sign is quickly interchangeable.

It is a further object of the invention to provide a cross arm type yard sign support formed from metal extruded so that the cross arm forms a rigid cross joint with the upright post.

It is still a further object of the invention to provide a yard sign support post having a cross arm formed from a special extrusion having a groove along its top surface for accepting a plastic insert for holding a rider sign.

It is yet a further object of the invention to provide a yard sign support post having a cross arm extrusion in which threaded hooks or the like can be quickly and securely engaged in the underside of the cross arm at any point along the arm.

It is another object of the invention to provide a cross arm type yard sign support having base spikes for insertion into the ground which can be installed by foot pressure and do not require digging.

It is another object of the invention to provide a yard sign support post formed from extruded metal to accept a stabilizer block and base spikes at the bottom end thereof to provide rigidity and strength.

It is another object of the invention to provide a cross arm type yard sign support post which may be quickly assembled and which will have a long service life.

These and other objects and advantages of the invention will become apparent from the following detailed description when read in light of the drawings.

BRIEF DESCRIPTION OF THE DRAWING

FIG. 1 is a perspective view of a cross arm type yard sign support post in accordance with the invention;

FIG. 3 is a cross sectional view 3—3 of the cross arm shown in FIG. 2;

FIG. 4 is a partial cross-sectional view of the cross arm showing the rider sign channel, plastic insert, and a portion of a rider sign installed therein;

FIG. 6 is a cross-sectional view taken along lines 6—6 of FIG. 1 and FIG. 7 is a perspective view of the stabilizer block insert of the invention.

DETAILED DESCRIPTION OF THE PREFERRED EMBODIMENT

Figures 2, 5:
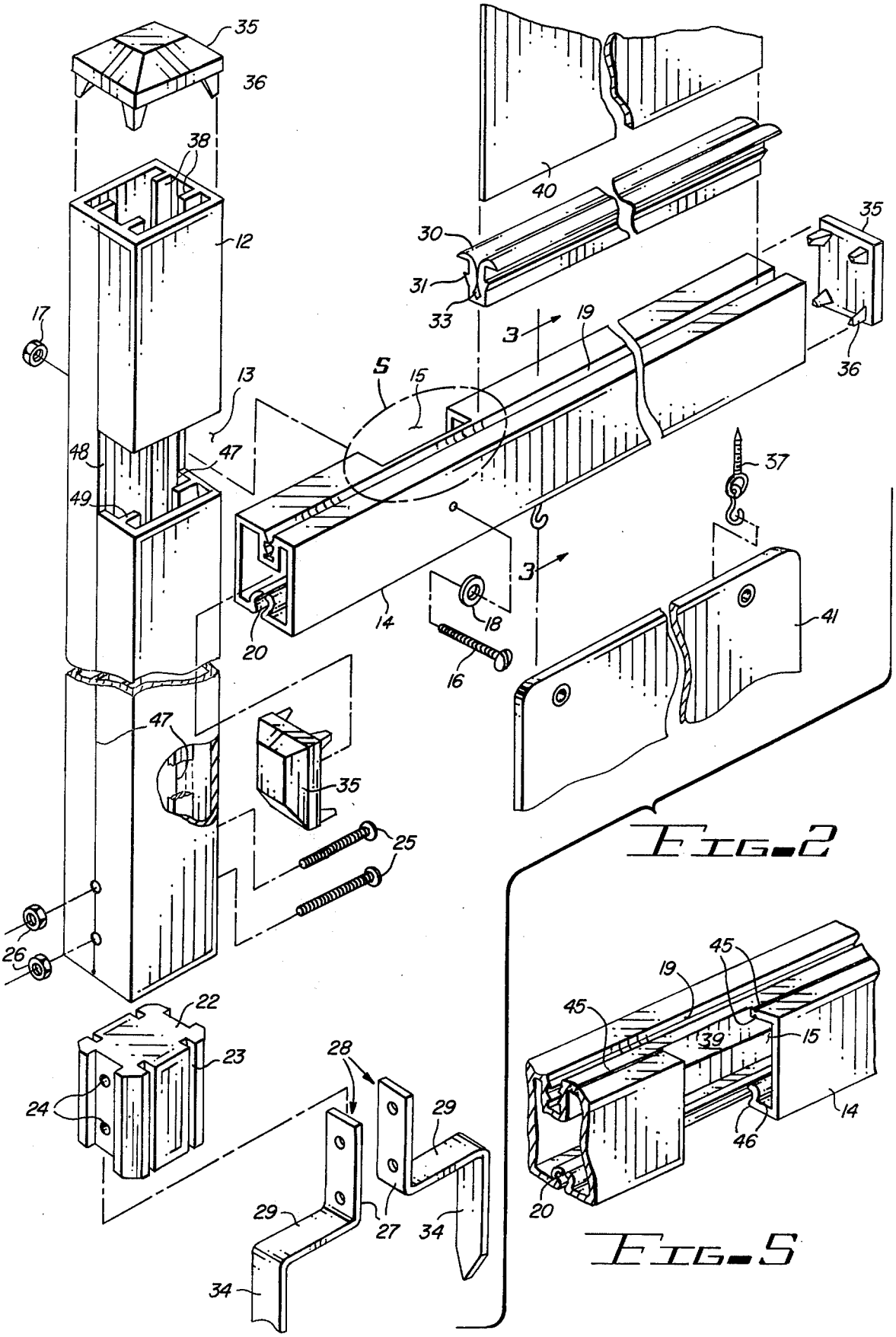
FIG. 2 is an exploded perspective view of the cross arm type yard support post showing the various features thereof.
FIG. 5 is a partial view of the cross arm of FIG. 2 in the encircled area 5 showing details of the cross arm cutout.

Referring to FIG. 1, a perspective view of a typical cross arm type yard sign support is shown which represents a preferred embodiment of the invention. Shown generally at 10, the support includes a vertical post 12 having a cross arm 14 attached at right angles thereto. The base of the post 12 is adapted to be installed in the ground by means of a pair of spike elements 28 attached to the lower end of post 12. Spike elements 28 are provided with step section 29 which will allow the user to force the spikes into the ground by pushing on step portions 29 with the foot or heel or, in hard soil, by use of a hammer or other object. Cross arm 14 is attached to post 12 by bolt 16. The upper surface of arm 14 includes a groove or channel 19 extruded therein. Arm 14 extends a short distance on one side of post 12 and a greater distance on the opposite side to provide space for the signs to be attached. The dimensions of the short projecting end and the projection of the post above the cross arm are selected to provide both strength and an attractive appearance to the structure. The longer arm end of cross arm 14 includes a plastic insert 30 in channel 19 for acceptance of an auxiliary or rider type sign 40 which may be required to be changed occasionally. As will be described in more detail hereinafter, insert 30 securely grips rider sign 40 yet allows convenient interchange of such signs. The underside of cross arm 14, as will be shown in more detail below, includes provisions for inserting hook screws or eye bolt screws therein from which to hang a large or main sign 41. Advantageously, such hooks or eye bolts may be inserted at any point along the underside of arm 14. Caps 35, which may be of molded plastic or the like, are utilized to finish off the open ends of the extruded arm 14 and post 12 for appearance and to prevent water intrusion.

Turning now to FIG. 2, an exploded view of the yard sign support in accordance with the invention is shown and, in conjunction with the various detail figures, will be used to disclose the novel features of the invention. While various metals or other material of suitable strength may be used to fabricate the sign support of the invention, dependent on the desired size and weight of the signs to be supported, aluminum is the preferred material for real estate use and the like. Upright post 12 is preferably an aluminum extrusion having special functional internal splines 38 provided which also add structural rigidity and strength to the support. Functionally, the internal splines 38 support spike elements 28 as well as simplify and reduce the cost of fabrication and assembly. In the preferred embodiment, post 12 is a rectangular shape, although the post may also be square, round, or other desired cross-sectional shape. In one embodiment, post 12 and cross arm 14 have a face width of 2" and a depth of 1.75". Cross arm 14 is mortised to post 12 by means of mating cutouts 13, (in post 12) and 15 (in cross arm 14).

To facilitate cutting of cutouts 13 and 15 during production, grooves are scored in the respective extrusions. In post 12, grooves 47, which may be 0.005" in depth, are scored along the outside sides and along the inner surfaces as shown in the cutaway portion. Similar grooves are scored in the top and bottom portions of cross arm 14 best seen with reference to FIGS. 3 and 4. As seen in FIGS. 3 and 4, score marks 45 are extruded into the top surface of cross arm 14 immediately adjacent to channel 19. Marks 46 are extruded in the bottom surface of arm 14 along the base of one portion of screw channel 20 as seen in FIG. 3. To produce cutout 13, for example, two cuts are made on post 12 from one face halfway through the sides and spaced —2" to accept the face of cross arm 14. The cut portion may then be grasped, squeezed and rocked slightly causing the aluminum to cleanly break along the score marks 47, thus eliminating blind sawing operations. Similarly, as seen most clearly in FIG. 5, cutout 15 in cross arm 14 is produced by sawing through the appropriate face of the cross arm extrusion approximately halfway, spaced to produce a 2" wide opening to mate with post 12. Again, the cut section is removed by squeezing and bending to cause the metal to cleanly break along score marks 45 and 46. The internal splines 38 in post 12 and the extruded channels 19 and 20 in cross arm 14 cooperate to provide a rigid mortise when cross arm 14 is installed on post 12. At assembly, cutout 15 in cross arm 14 is fitted into cutout 13 and secured by bolt 16, washer 18, and nut 17. Advantageously, cutting of post 12 to form cutout 13 cuts through one pair of splines 38, producing lateral faces 49 for both top and bottom cuts. In conjunction with the cut face and sidewalls of post 12, the faces 49 provide a large bearing area contacting the upper and lower surfaces of cross arm 14 when installed. This bearing area therefore produces greater vertical strength and rigidity at the cross arm-post mortise joint than possible with wall area alone. Next, as best seen in FIG. 5, the cutout 15 in cross arm 14 produces a bearing surface 39, which is the inside face of channel 19 due to the offset from center line as shown in FIG. 3 and which bears against vertical wall section 48 of post 12. Similarly, one half of channel 20 in the bottom surface of cross arm 14 provides additional bearing surface against wall section 48. The construction increases the horizontal rigidity of the joint. Thus, the functional extrusions serve a two-fold purpose and here greatly minimize wear at the cross arm post joint which can occur due to the weight of signs and effects of wind on the structure.

In general, real estate brokers will utilize a large standardized metal sign 41 having the broker's name prominently displayed along with other general information with the appropriate for sale or for rent type legend thereon. It is contemplated that such a sign will be suspended below cross arm 14. To provide maximum flexibility, channel 20 is provided along the lower surface of arm 14 for accepting hardware to hang such a sign 41. Channel 20, as may be seen from FIGS. 3 and 5, consists of two C-shaped members having the open sides thereof horizontally opposed. As extruded, channel 20 may be essentially closed at its top and bottom edges with a very thin web of aluminum preventing separation. When a sign 41 is to be hung, a screw eye 37 in FIG. 3 having a conventional wood screw thread may be screwed into channel 20 at the appropriate location along arm 14. A steel thread will easily cut through the softer aluminum and the C-shaped side members of channel 20 will securely hold the screw portion of screw eye 37 at two points along its threads. Normally, two or more such screw eyes would be inserted into channel 20 as required for the particular sign to be held. While a screw eye 37 has been shown for illustration, hook screws or S-hooks may also be utilized.

In addition to the standardized sign which may normally be hung below arm 14, it is usually desirable to have a so-called rider sign or auxiliary sign carrying a specific or special message with regard to the property being advertised. For example, such signs may give the number of bedrooms, baths, indication of a swimming pool, and many other such messages. After a property is sold, or on which a sale is pending, it is common for the broker to maintain his sign on the property as long as possible for its general publicity value. He also desires to display a "sold" sign to emphasize his successful sale. It is therefore desirable that a rider sign indicating some feature of the property be easily removable and a sold sign installed in its place. Advantageously, in accordance with the invention, channel 19 is utilized in conjunction with insert 30 to provide this feature. As seen in FIG. 2, insert 30 has a length essentially equal to the sign supporting arm 14 and, as seen in cross section in FIG. 4, is inserted into channel 19 of arm 14. Insert 30 is fabricated from a pliable plastic material or the like such as polypropylene. It is formed to have a groove 32 along the center line of its length formed by essentially splitting the insert lengthwise and forming a recess 33 along its length. The upper portion of slot 32 may be outwardly curved as shown in FIG. 4 to facilitate inserting of a thin rider sign 40 therein with the resiliency of the plastic producing sufficient friction to securely grip the sign. Insert 30 is also provided with a saw tooth like projection 31 on either side thereof and running for the length of the insert. Channel 19 includes matching saw tooth projections 21 on the faces inside of channel 19. As seen from FIG. 4, projections 31 catch the upper set of saw tooth projections 21 in channel 19 to permit a rider sign 40 to be removed by pulling outward from insert 30 without the insert coming out of channel 19. The lower set of saw tooth projections 21 in channel 19 serve to maintain rider sign 40 upright in insert 30.

To close off the open ends of the extrusions of cross arm 14 and post 12, decorative caps 35 may be provided. While caps 35 may be fabricated from a variety of material, a plastic such as polypropylene is suitable. Caps 35 have four wedge shaped corner projections 36 which form a forced fit into the inner corners of the extrusions. Caps 35 give a finished, attractive finish to the post and arm and also prevent water intrusion for protection of the metal.

To provide strength and rigidity at the base of post 12, a novel stabilizer assembly is provided. As seen in the exploded view of FIG. 2 and with reference to FIGS. 6 and 7, spike elements 28 are attached to the base of post 12 by means of stabilizer block 22, bolts 25 and nuts 26. Spike elements 28 are preferably formed from flat steel stock with a point section 34, a step section 29 at right angles to point section 34 and a vertical attachment portion 27 projecting at right angles upward from step section 29. Stabilizer block 22, preferably fabricated from a pliable plastic such as polypropylene or the like, is formed to fit snugly into the extrusion of post 12 as best seen in cross-section in FIG. 6. Grooves 23 are molded into the wide faces of stabilizer block 22 to provide tension upon insertion of block 22 into the extrusion of post 12, thus assisting to maintain the rigidity of the lower portion of post 12. The narrow faces of stabilizer block 12 have a wide groove formed therein which straddles splines 38, as seen in FIG. 6, when block 22 is inserted in the lower end of post 12. As may be also noted from FIG. 6, the upright ends 27 of spike elements 28 fit snugly between splines 38 and against the faces of block 22. Holes 24 through stabilizer block 22 match the mounting holes in the lower end of post 12 and in the upright ends 27 of spike elements 28 to accept bolts 25. This novel design permits two bolts to be used without deforming of post 12, and also provides a means for rapid assembly during production. As may be noted in FIG. 7, the lower end of stabilizer block 22 includes a short projection 42 therefrom. During assembly block 22 is first inserted in the lower end of post 12 until projection 42 is stopped by the extrusion. At this point holes 24 are accurately aligned with the bolt holes in post 12. Next the two spike elements 28 have their upper ends 27 inserted into the slots now formed in the lower end of post 12 by splines 38 and stabilizer block 22. Spike elements 28 are then pushed up until the step portion 29 contacts the lower end of post 12 at which point the mounting holes in upright portions 27 match the post 12 mounting holes. Bolts 25 may be then inserted and locked in place with locking-type nuts 26. As may be recognized, this production operation is performed quickly and easily without special alignment steps being required.

It is contemplated that the novel cross arm type yard sign support of the invention will be supplied to the user with the spike elements installed in the post, the insert installed in the cross arm, but with the cross arm and post not connected. Thus, a unit is easily carried in a car or station wagon. To install, the user first stands the post upright on the spikes at the desired location. He may then push the spike elements into the ground by stepping or standing on the step portions 29 of spike elements 28. Where the ground is particularly hard, a hammer, axe, or even a large block of wood may be used to tap the spike points into the ground. Forcing the spike elements into the ground to the point where horizontal step portions are flush with the ground produces maximum stability. While two spike elements have been shown for exemplary purposes, it is obvious that a second pair of spike elements at right angles can be used in accordance with the invention where additional stability may be required. Similarly, horizontal step portions 29 may be enlarged or have right angle projections added thereto to provide a greater area in contact with the ground for additional stability when necessary. After the post is installed, a desired rider sign may be inserted in insert 30 of cross arm 14, and the necessary screw eyes or screw hooks threaded into channel 20 if not previously done. Cross arm 14 is then inserted in place on post 12 by interlocking notches 13 and 15 and inserting screw 16 with washer 18 through cross arm 14 and the back of vertical post 12. Lock nut 17 is then applied and tightened until snug. For portable and reusable applications, it may be desirable to use a wing nut to facilitate installation and removal without tools. Finally, the major sign is hung from the cross arm 14 on the screw eyes or screw hooks 37 and the installation is then complete.

As may now be seen, a novel cross arm type yard sign support has been disclosed which is lightweight and rigid, and can be manufactured and assembled at relatively low cost. The support is quickly installed and supports a large major sign as well as an auxiliary or rider sign which may be easily removed and replaced. The strength and rigidity of the support is a result of the use of special extrusions for the vertical post and the cross arm in conjunction with ancillary hardware. Four internal splines in the vertical post permit a relatively thin wall tubing to be used by providing rigidity. The splines are also utilized to form a snug fit with flat metal spike elements in conjunction with a novel stabilizer block that fits tightly into the lower end of the post to further hold the spike elements in place and to provide cross sectional rigidity at the base of the post. Similarly, channels extruded into the cross arm section provide rigidity to that portion and serve functionally to support signs. The upper channel, by means of a novel plastic insert, supports small rider signs that are therefore quickly and easily changeable. The bottom channel advantageously accepts sign mounting hooks or screw eyes at any point along the arm for maximum flexibility of hanging various size signs. The combination of the above disclosed elements of the structure of the invention provides economy, utility, and convenience to the user of portable type yard signs not heretofore available.

While a particular preferred embodiment has been described in detail to illustrate the invention, it will be obvious to those of ordinary skill in the art that the same novel features can be adapted to various shapes, sizes, and materials of construction without departing from the spirit and scope of the invention.

I claim:

1. A support post for signs and the like comprising:

a vertical post formed from a hollow metal tube having a plurality of vertical internal splines;

a downward projecting spike assembly attached to the lower end of said vertical post and adapted to be forced into the ground by foot pressure or the like; and a horizontal crossarm attached to said vertical post near the upper end thereof, said horizontal crossarm formed from a hollow metal tube having a first channel formed in the lower surface thereof and a second channel formed in the upper surface thereof, said first channel adapted to accept sign supporting screws at any selected point along said first channel, said second channel for accepting a pliable insert having a groove therein for accepting the lower edge of an auxiliary sign whereby said sign is held in a vertical position by friction between said sign and said insert;

said vertical post having a cutout portion thereof, said cutout portion being cut through at least some of said vertical internal splines, and said horizontal crossarm having a cutout portion thereof adapted to match with and fit into said vertical post cutout, said crossarm cutout portion cut to provide a face of said first channel and a face of said second channel to bear against said vertical post cutout portion, and portions of said upper and lower surfaces arranged to bear against said cut spline surfaces to thereby form a rigid vertical post/horizontal crossarm joint.

2. The support post as defined in claim 1 in which:

outside surfaces and inside surfaces of said vertical post are scored to facilitate production of said cutout portion without requiring vertical cutting thereof; and said horizontal cross arm is scored along inside and outside surfaces thereof to facilitate production of said cross arm cutout portion without requiring longitudinal cutting thereof.

3. The support post as defined in claim 1 in which said first channel in said horizontal cross arm includes two elongate C-shaped members formed in said lower surface of said cross arm, the two open faces of said C-shaped members being horizontally opposed and spaced to permit said sign holding screws to be threaded through said lower opposed portions and upper portions of said C-shaped elements.

4. The support post as defined in claim 1 in which:

said spike assembly includes at least two metal spikes having a downward projecting pointed portion for insertion in the ground, a horizontal extending portion connected to said downward extending portion forming a step like area to be used for forcing said downward projecting portion into the ground, and a vertical upward extending portion connected to the inner end of said step like portion, said upward extending portion having mounting holes therein;

stabilizer block means for insertion into the lower end of said vertical post, said stabilizer block having grooves formed therein for matching said vertical splines, said vertical splines and said grooves forming an opening for receiving said vertical portions of said spike assembly, and said lower end of said post and said stabilizer block having holes therethrough for matching said mounting holes in said vertical portions of said spike assembly, and mounting bolts inserted through said holes in said vertical post, said stabilizer block, and said vertical portions of said spike assembly for securing said spike assembly to said post.

5. A support post for yard signs and the like of the type to be temporarily installable and removable and having a cross arm for supporting a primary sign and an auxiliary sign, comprising:

an interior vertical post formed from hollow metal tubing having a plurality of vertical interior splines, said post having a cutout portion adjacent the upper end thereof, said cutout portion being cut through at least some of said vertical internal splines;

a horizontal cross arm formed from a hollow metal tube having a first longitudinal channel along the upper surface thereof, a screw receiving second longitudinal channel along the lower surface thereof, and a cutout portion arranged to create an interlocking mortised joint between said vertical post and said horizontal cross arm, said cross arm cutout portion cut to provide a face of said first channel and a face of said second channel to bear against said vertical post cutout portion, and portions of said upper and lower surfaces arranged to bear against said cut spline surfaces to thereby form a rigid mortised joint;

primary-sign supporting screws threaded into said second channel to support a primary sign, said second channel adapted to allow said sign supporting screws to be inserted at selected locations along said lower surface of said horizontal arm in accordance with the primary sign to be supported;

auxiliary sign support insert disposed in said first channel, said insert formed from polypropylene plastic and having a longitudinal slot formed therein, said slot adapted to permit insertion of the lower edge of an auxiliary sign thereinto, whereby said insert serves to maintain said auxiliary sign vertical and to permit said auxiliary sign to be easily installed and removed;

a plurality of post support flat metal spikes, each of said spikes having an outer downward projecting pointed section thereof, a horizontal inward directed step portion thereof attached to said downward projecting portion, and an upward projecting portion attached at the inner end of said horizontal step portion, said upward projecting portion having mounting holes therein; and stabilizer block formed to fit snugly into the lower end of said vertical post, said stabilizer block having mounting holes therethrough and spike receiving grooves therein, said stabilizer block adapted to be inserted in said lower end of said vertical post, said lower end of said post having spike mounting holes matching said mounting holes in said stabilizer block, said grooves in said stabilizer block cooperating with said vertical splines to form slots for receiving of said upright portions of said spikes, and adapted to receive bolts through said holes in said vertical post, said upright portions of said spikes, and said stabilizer block thereby forming a rigid base portion of said vertical post adapted to be inserted in the ground by downward force on said horizontal step portions of said spikes.

6. A support post for yard signs and the like having a crossarm for supporting a primary sign and an auxiliary sign comprising:

a vertical post formed from hollow metal tubing having a plurality of vertical interior splines, said post having a cutout portion adjacent the upper ends thereof, said cutout portion being cut through at least some of said vertical internal splines; and a horizontal crossarm formed from hollow metal tubing, said crossarm tubing having a first longitudinal channel means projecting inwardly from the lower surface thereof, said first channel means having a first function of accepting primary sign hangers for suspending a primary sign therefrom, said crossarm tubing having a second longitudinal channel means projecting inwardly from the upper surface thereof, said second channel means having a first function of accepting and supporting an auxiliary sign, said crossarm tubing having a cutout portion complementary to said vertical post cutout portion and arranged to create an interlocking mortised joint between said vertical post and said horizontal crossarm, said first and second channel means having second functions of providing bearing surfaces for contacting cut portions of said vertical post in said vertical post cutout portion and portions of said upper and lower surfaces of said crossarm tubing arranged to bear against said cut spline surfaces and cut portions of said vertical post to thereby form a rigid mortised joint between said vertical post and said crossarm.

* * * * *

UNITED STATES PATENT AND TRADEMARK OFFICE

CERTIFICATE OF CORRECTION

PATENT NO. : 4,258,494

DATED : March 31, 1981

INVENTOR(S) : GEORGE O. BOURQUE

It is certified that error appears in the above-identified patent and that said Letters Patent are hereby corrected as shown below:

On the cover page the name "Borque" below the phrase "United States Patent" should read --Bourque--. In the first column of the cover page, second line, the name of the inventor "George O. Borque" should read --George O. Bourque--.

Signed and Sealed this

*Fifth* Day of *January 1982*

[SEAL]

*Attest:*

GERALD J. MOSSINGHOFF

*Attesting Officer*

*Commissioner of Patents and Trademarks*